US011377335B2

(12) United States Patent
Angerer et al.

(10) Patent No.: US 11,377,335 B2
(45) Date of Patent: Jul. 5, 2022

(54) METHOD FOR FILLING CONTAINERS WITH A FILLING PRODUCT

(71) Applicant: KRONES AG, Neutraubling (DE)

(72) Inventors: Florian Angerer, Neutraubling (DE); Cornelia Rupp, Neutraubling (DE); Valentin Becher, Neutraubling (DE); Josef Doblinger, Neutraubling (DE); Tobias Bock, Neutraubling (DE)

(73) Assignee: KRONES AG, Neutraubling (DE)

( * ) Notice: Subject to any disclaimer, the term of this patent is extended or adjusted under 35 U.S.C. 154(b) by 23 days.

(21) Appl. No.: 16/641,165

(22) PCT Filed: Aug. 20, 2018

(86) PCT No.: PCT/EP2018/072416

§ 371 (c)(1),
(2) Date: Feb. 21, 2020

(87) PCT Pub. No.: WO2019/038224

PCT Pub. Date: Feb. 28, 2019

(65) Prior Publication Data

US 2020/0198954 A1 Jun. 25, 2020

(30) Foreign Application Priority Data

Aug. 21, 2017 (DE) ..... 10 2017 119 069.4

(51) Int. Cl.
*B67C 3/28* (2006.01)
*B67C 3/26* (2006.01)
(Continued)

(52) U.S. Cl.
CPC ..... *B67C 3/286* (2013.01); *B67C 3/26* (2013.01); *B67C 3/007* (2013.01); *B67C 3/20* (2013.01);
(Continued)

(58) Field of Classification Search
CPC ..... B67C 3/286; B67C 3/26; B67C 3/007; B67C 3/20; B67C 3/287; B67C 2003/2685; B67C 3/28; F17C 2250/0426
(Continued)

(56) References Cited

U.S. PATENT DOCUMENTS 5,823,234 A * 10/1998 Boertz ..... B67C 3/202 141/67
2014/0261714 A1* 9/2014 Burt ..... G05D 23/1919 137/10
2016/0016773 A1* 1/2016 Angerer ..... B67C 3/286 141/1

FOREIGN PATENT DOCUMENTS

CN 103429524 A 12/2013
CN 105270661 A 1/2016
(Continued)

OTHER PUBLICATIONS

Excerpt from Mott, Chapter 12: "Applied Fluid Mechanics", found at https://scetcivil.weebly.com/uploads/5/3/9/5/5395830/fluids_chap12.pdf (Year: 2005).*
(Continued)

*Primary Examiner* — Timothy P. Kelly
*Assistant Examiner* — Christopher M Afful
(74) *Attorney, Agent, or Firm* — Haynes and Boone, LLP

(57) ABSTRACT

A method for filling a container with a filling product in a filling-product filling system having a control valve, having the steps:

a differential pressure $\Delta p_v$ decreasing across the control valve; and regulating and/or controlling the control valve as a function of the differential pressure $\Delta p_v$ which has been determined.

12 Claims, 8 Drawing Sheets

(51) Int. Cl.
*B67C 3/00* (2006.01)
*B67C 3/20* (2006.01)

(52) U.S. Cl.
CPC ..... *B67C 3/287* (2013.01); *B67C 2003/2685* (2013.01); *F17C 2250/0426* (2013.01)

(58) Field of Classification Search
USPC ..... 137/485, 486, 487, 488; 73/861.52, 73/861.62
See application file for complete search history.

(56) References Cited

FOREIGN PATENT DOCUMENTS

| | | |
|---|---|---|
| EP | 1127835 | 8/2001 |
| EP | 2695846 | 2/2014 |
| WO | WO 97/00224 | 1/1997 |

OTHER PUBLICATIONS

"Pressure in Parallel Circuits", video found at https://www.youtube.com/watch?v=N_0-H8nxQdo (Year: 2016).*
Chinese Office Action dated Apr. 2, 2021, Chinese Patent Application 201880068596.5, 6 pages.

* cited by examiner

METHOD FOR FILLING CONTAINERS WITH A FILLING PRODUCT

CROSS REFERENCE TO RELATED APPLICATIONS

This application is a national stage of International Application No. PCT/EP2018/072416, filed Aug. 20, 2018, which claims priority from German Patent Application No. 10 2017 119 069.4 filed on Aug. 21, 2017 in the German Patent and Trademark Office, the disclosures of which are incorporated herein by reference in their entirety.

BACKGROUND

Technical Field

The present invention relates to a method for filling containers with a filling product in a filling-product filling system.

Related Art

In filling-product filling systems, it is known to fill containers to be filled with a filling product, the actual introduction of the filling product into the respective container to be filled being carried out by means of a so-called filling valve. The filling valve constitutes a connection between the filling-product reservoir, in which the filling product to be filled is provided before the actual filling, and the container to be filled. By means of the filling valve, the filling process is initiated and the filling product is delivered into the container to be filled, and after reaching a predetermined specification, for example after reaching a predetermined filling weight, a predetermined filling level or a predetermined filling volume, the filling process is ended. In order to determine the respective filling and therefore in order to determine the respective state or time at which the filling valve is closed again, various sensors are known, by means of which for example the filling level, the filling weight or the filling volume of the filling product in the container to be filled is determined.

Filling valves are known by means of which only opening and closing of the respective connection between the filling-product reservoir and the container to be filled are achieved. Upstream of these simply switching filling valves, there is often a throttle device by means of which modulation of the filling-product flow into the container to be filled can be achieved.

Furthermore known are filling valves, which are also referred to as proportional valves, in which the respective filling-valve disk can be raised or lowered in relation to its filling-valve seat in stages or continuously, so that the gap, or annular gap, formed between the filling-valve disk and the filling-valve seat can be correspondingly varied in its cross section. Correspondingly, for such a proportional valve a variation of the effective cross section and therefore a variation of the filling-product flow flowing through the proportional valve can also be achieved. With the proportional valve, it is therefore possible to specify, or control, a predetermined volume-flow profile for the filling of the respective container to be filled. It is therefore possible, for example, initially to introduce a reduced filling-product flow into the container to be filled at the start of the filling process, so as to reduce a susceptibility to foaming. In the range of the main filling of the container to be filled, on the other hand, a volume flow that is as high as possible is adjusted in order to achieve rapid filling of the container to be filled. Toward the end of the filling process, the volume flow is then reduced again in order to allow reliable reaching of the respective predetermined filling and to avoid overflow or spraying of the filling product out from the container to be filled.

Proportional valves are often coupled in a control loop to a flow meter assigned to this proportional valve. In this way, by means of the combination of the flow meter and the proportional valve, from a superordinate system controller it is possible to specify a volume flow which is then maintained by means of the control loop. However, both the flow meter and the corresponding evaluation device and the control of the proportional valve entail a certain inertia and time delay, so that immediate reaction to variations of the initial conditions and, in particular, to variations in the feed of the filling product to the proportional valve can only be compensated for with a certain time delay. Furthermore, flow meters are often dependent on the properties of the respective filling product.

With a design of a filling device in a filling-product filling device such that each filling valve is connected directly to the filling-product reservoir, for example in a design in which the filling valves arranged around the circumference of a filler carousel are respectively connected individually to the filling-product reservoir, for example in the form of a central tank or an annular tank, the filling-product reservoir acts as a buffer in such a way that each filling valve, and in particular each proportional valve, is operated independently of the other filling valves or proportional valve. In other words, the initial conditions for the respective filling valve do not vary when a neighboring filling valve is opened or closed, since the filling-product reservoir acts as a large-volume buffer.

In an alternative system design, however, in which at least two of the filling valves or a multiplicity of filling valves or all the filling valves, are connected to the filling-product reservoir by means of a single common filling-product supply line, influencing of the initial conditions for each individual filling valve takes place because of the properties of the line. This is the case, for example, when the filling-product reservoir, in which the filling product to be filled is provided, is configured as an adjacent tank and the filling product is connected by means of a single filling-product supply line, which is fed by a rotary distributor to the respective filler carousel, to all the filling valves of the filler carousel.

In particular, in this configuration the pressure provided in the filling-product supply line decreases when, at the start of the filling operation, beginning with a state in which all the filling valves are closed, one filling valve after another is opened. The filling-product supply line cannot then act as a substantially unlimited buffer, but rather the volume flow flowing through the filling-product supply line is dependent to the fourth power on the line radius.

The filling valves correspondingly influence one another—at least until a stabilized equilibrium state has been set up. This may have the effect that, even in the case of a filling valve regulated by means of a flow meter, the through-flow actually required is not achieved at least toward the start of the respective filling operation because of the inertia of the control loop.

This behavior of the filling valves is also observed toward the end of the filling operation if all the filling valves are gradually closed before production is ended. In this case as well, even in the case of a filling valve regulated by means of a flow meter, the through-flow actually required is not achieved toward the end of the respective filling operation because of the inertia of the control loop.

SUMMARY

A method for filling containers with a filling product in a filling-product filling system, which exhibits an improved filling behavior, is described according to various embodiments.

A method is provided for filling a container with a filling product in a filling-product filling system having a control valve, having the following steps: determining a differential pressure $\Delta p_v$ decreasing across the control valve, and regulating and/or controlling the control valve as a function of the differential pressure $\Delta p_v$ which has been determined.

Because the control and/or regulation of the control valve is carried out on the basis of differential pressure $\Delta p_v$, it is possible to achieve very reliable regulation which responds rapidly, is decoupled from the properties of the filling product and no longer has the inertia of a flow sensor. Reliable and rapid control and/or regulation behavior may therefore be achieved in a filling-product filling system.

In one embodiment, a function of the volume flow $q(t, \Delta p_v)$ for the control valve is determined as a function of the differential pressure $\Delta p_v$ decreasing across the control valve, the volume flow $q(t,\Delta p_v)$ through the control valve is calculated on the basis of the differential pressure $\Delta p_v$ which has been determined, and the control valve is regulated and/or controlled as a function of the calculated volume flow $q(t,\Delta p_v)$. t is in this case the time.

In this way, further components of the control behavior may also be included, and in particular the transient behavior of the control valve may be taken into account.

In some embodiments, at least two filling valves connected in parallel with one another are provided in the filling-product filling system, and a function of the volume flow $q\ (t,\Delta p_v)$ is determined for at least two of the filling valves connected in parallel as a function of a differential pressure $\Delta p_v$ across the filling valves connected in parallel, the differential pressure $\Delta p_v$ across the filling valves connected in parallel is determined, the volume flow $q(t,\Delta p_v)$ through at least one of the filling valves connected in parallel is calculated on the basis of the differential pressure $\Delta p_v$ which has been determined, and the at least one filling valve is controlled and/or regulated as a function of the calculated volume flow $q(t,\Delta p_v)$.

Because the function of the volume flow $q(t,\Delta p_v)$ is determined as a function of a differential pressure $\Delta p_v$ across the filling valves connected in parallel with one another, and the at least one filling valve is regulated as a function of the calculated volume flow $q(t, \Delta p_v)$, it is possible for the regulation behavior during the filling of the respective containers to be improved. In particular, because of the lower inertia of the differential pressure measurement, it is possible to react more rapidly to a variation of the differential pressure within the device, the latter usually being due to further filling valves connected in parallel being switched on or off.

In other words, on the basis of the method, even with a design of a device having a plurality of filling valves connected in parallel with one another, which are successively switched on and off throughout the filling process, it is nevertheless possible for a reliable and uniform filling result to be achieved in the respective containers to be filled.

For example, in a start-up phase in which the filling process begins and correspondingly the first filling valve is initially opened, all the other filling valves still being closed, a higher differential pressure results so that initially, in principle, because of this differential pressure a higher volume flow is to be expected through the opened filling valve, or the few opened filling valves. In order then to achieve the desired volume flow into the container to be filled, the corresponding filling valve is regulated or controlled according to the calculated volume flow in relation to the desired volume flow so that it is opened less far. Therefore, as a function of the calculated volume flow, the influx of the filling product with the desired volume flow can correspondingly be achieved on the basis of the differential pressure which has been determined.

As soon as the second filling valve then opens in order to fill a subsequent container on the filler carousel with the filling product, the differential pressure decreasing across the filling valves correspondingly decreases to some extent so that the volume flow through the first filling valve and then also through the second filling valve slightly decreases. By means of determining the differential pressure, it is possible for the corresponding volume flow at the first filling valve to be predicted correctly and for the first filling valve to be correspondingly opened a little more together with the decrease in the differential pressure, in order to continue to maintain the desired volume flow. The regulation with the aid of the differential pressure in this case reacts much more rapidly than, for example, regulation by means of a flow meter could. A time delay in the regulation of the filling valve is therefore less and the result achieved, i.e. maintaining the predetermined volume flow, is therefore more accurate by the regulation and/or control with the aid of the calculated volume flow.

Correspondingly, by the function which has been determined for the volume flow, and which depends on the differential pressure across the filling valves connected in parallel with one another, the volume flow through the filling valve can be calculated and, in the event of a correspondingly varying differential pressure across the filling valves connected in parallel with one another, the opening excursion of the filling valves can be adapted in order respectively to maintain the desired, or predetermined, volume flow into the respective containers to be filled, independently of the number and the opening extent of the further filling valves connected in parallel.

As soon as full operation and a stabilized equilibrium of the simultaneously opened filling valves have being set up, a variation of the differential pressure, which results from the opening and closing of the respective filling valves, is scarcely still detectable owing to the multiplicity of simultaneously opened valves. Correspondingly, during full operation readjustment of the respective filling valves on the basis of the differential pressure which has been determined and the volume flow calculated by means of this continues to take place only to a very small extent.

Therefore, in various embodiments, it may be advantageous to suspend the corresponding regulation and/or control of the filling valve as a function of the calculated volume flow during full operation, or to carry out the regulation and/or control only when the resulting excursion of the filling valve exceeds a particular threshold to be established. In other words, it is in this way possible to prevent high-frequency control or regulation of the filling valves arranged in parallel with one another from taking place during full operation. Rather, only longer-term variations in the pressure, which for example allow a trend to be recognized, are taken into account and compensated for. Such a trend may, for example, exist when the filling-product reservoir, from which the feed of filling product to the filling valves connected in parallel with one another is carried out, has a modified level or modified pressure conditions. Correspondingly, by means of the proposed method it is also possible to achieve compensation in a case in which the overall pressure applied across the filling valves is modified because of the feed of the filling product.

Particularly, in several embodiments, a volume-flow profile specified by the filling method for the respective filling product and container respectively to be filled is specified. The filling valves are, for example while being regulated by means of their respective individual flow meters, adjusted toward the predetermined volume-flow profile. Correspondingly, the respective filling valve is adjusted toward a predetermined opening value, for which it is assumed that it corresponds to the corresponding volume flow specified by the volume-flow profile, and then regulated accurately to this value by means of the respective flow meter.

The regulation and/or control by means of the proposed method, which allows compensation of the filling-product flow into the container to be filled on the basis of the differential pressure which has been determined, is superimposed on this control of the filling valve by means of the predetermined volume-flow profile.

In other words, by means of the measurement or determination of the differential pressure, which is substantially more rapid than the measurement of the through-flow, the corresponding filling valve can be controlled to the corresponding position which is given by the volume-flow profile with compensation by the calculated volume flow on the basis of the differential pressure which has been determined. The compensation on the basis of the differential pressure may be carried out, because of the rapidly reacting pressure sensors, for example in a time range of one millisecond. Regulation by means of a variation of the through-flow by means of the flow meter would, conversely, require a regulation time of about 50 milliseconds. Correspondingly, because of the compensation modulated onto the volume-flow profile provided, a more accurate filling behavior can be achieved so that filling errors can be avoided better.

In particular, at the very start of the filling process it is possible to fill with a correct filling-product volume flow. With each further filling valve that is open, the differential pressure across the filling valves connected in parallel with one another decreases, since the overall cross section of the open filling valves is increased and therefore the pressure applied above the filling valves is reduced. The volume flow through the individual filling valves is therefore also reduced in such a way that the filling valves have to be opened further in order to maintain the filling-product volume flow desired according to the volume-flow profile.

The same applies toward the end of the filling process, when the last container to be filled is passed through the system and one filling valve after another is correspondingly set into the closed position, and remains there. It is then the case that the differential pressure increases with each filling valve being closed and the volume flow which flows through the last filling valves would be a greater volume flow if countermeasures were not correspondingly taken and the filling valves were constantly closed further on the basis of the calculated volume flow.

The result is that both the first container filled and the last container filled are still filled correctly during the filling method, and the risk of respective filling errors is correspondingly reduced further.

Accurate compensation of the respective differential pressure also works particularly well in the described system design having a multiplicity of filling valves connected in parallel with one another since, because of their design, the filling valves in the form of proportional valves require a certain time for controlling the desired degree of opening. In other words, the respective filling valve is gradually moved from the fully closed position into the desired opening position. Correspondingly, abrupt opening of the filling valves does not take place as would be the case with pure switchover valves, but rather the opening takes place in such a way that the volume flow through the filling valve increases slowly and, correspondingly, the differential pressure, which is obtained by a filling valve opening further, is likewise reduced only slowly.

In combination with the much faster pressure sensor, which has a considerably faster determination behavior than for example a flow sensor, compensation of the respective filling valve being opened can correspondingly be achieved, which ultimately leads to an almost unaffected, or uniform, volume flow in the already opened filling valves.

In several embodiments, the regulation and/or control of the at least one filling valve correspondingly includes compensation of the opening position of the filling valve in the event of a varying differential pressure $\Delta p_v$ with the aid of the calculated current volume flow $(t,\Delta p_v)$.

In another embodiment, the regulation and/or control of the filling valve includes adjustment of an opening position of the filling valve with the aid of the current volume flow $(t,\Delta p_v)$.

In some embodiments, the regulation and/or control of the at least one filling valve is carried out while taking into account a predetermined volume-flow profile for the filling of the container to be filled with the filling product.

In various embodiments, the function of the volume flow $q\ (t,\Delta p_v)$ is given as a function of the differential pressure $\Delta p_v$ by $$q(t,\ \Delta p_v) = \begin{cases} q_\infty \cdot \tanh\left(\frac{\Delta p_v}{q_\infty \cdot L_h} \cdot t + \operatorname{arctanh}\left(\frac{q_0}{q_\infty}\right)\right), & \text{if } q_0 < q_\infty \\ q_\infty \cdot \coth\left(\frac{\Delta p_v}{q_\infty \cdot L_h} \cdot t + \operatorname{arccoth}\left(\frac{q_0}{q_\infty}\right)\right), & \text{if } q_0 > q_\infty \\ q_0, & \text{if } q_0 = q_\infty \end{cases}$$

$$q_\infty = K_v \cdot \sqrt{\frac{\Delta p}{1\ \text{bar}} \cdot \frac{1000\ \frac{\text{kg}}{\text{m}^3}}{\rho}}$$

is the volume flow through the filling valve in the stabilized state.

In this way, the volume flow may also be calculated for a compact system having a multiplicity of filling valves on the basis of the differential pressure, the mutual influencing of the volume flows of the filling valves with one another being taken into account by these equations. In other words, the calculation in this way allows more accurate calculation of the volume flow and therefore an improved filling result.

BRIEF DESCRIPTION OF THE FIGURES

Further embodiments of the invention are explained in more detail by the following description of the figures.

DETAILED DESCRIPTION

Exemplary embodiments will be described below with the aid of figures. In this case, elements which are the same or similar, or which have the same effect, are provided with identical references in the various figures, and repeated description of these elements is sometimes omitted in order to avoid redundancy.

Figure 1:
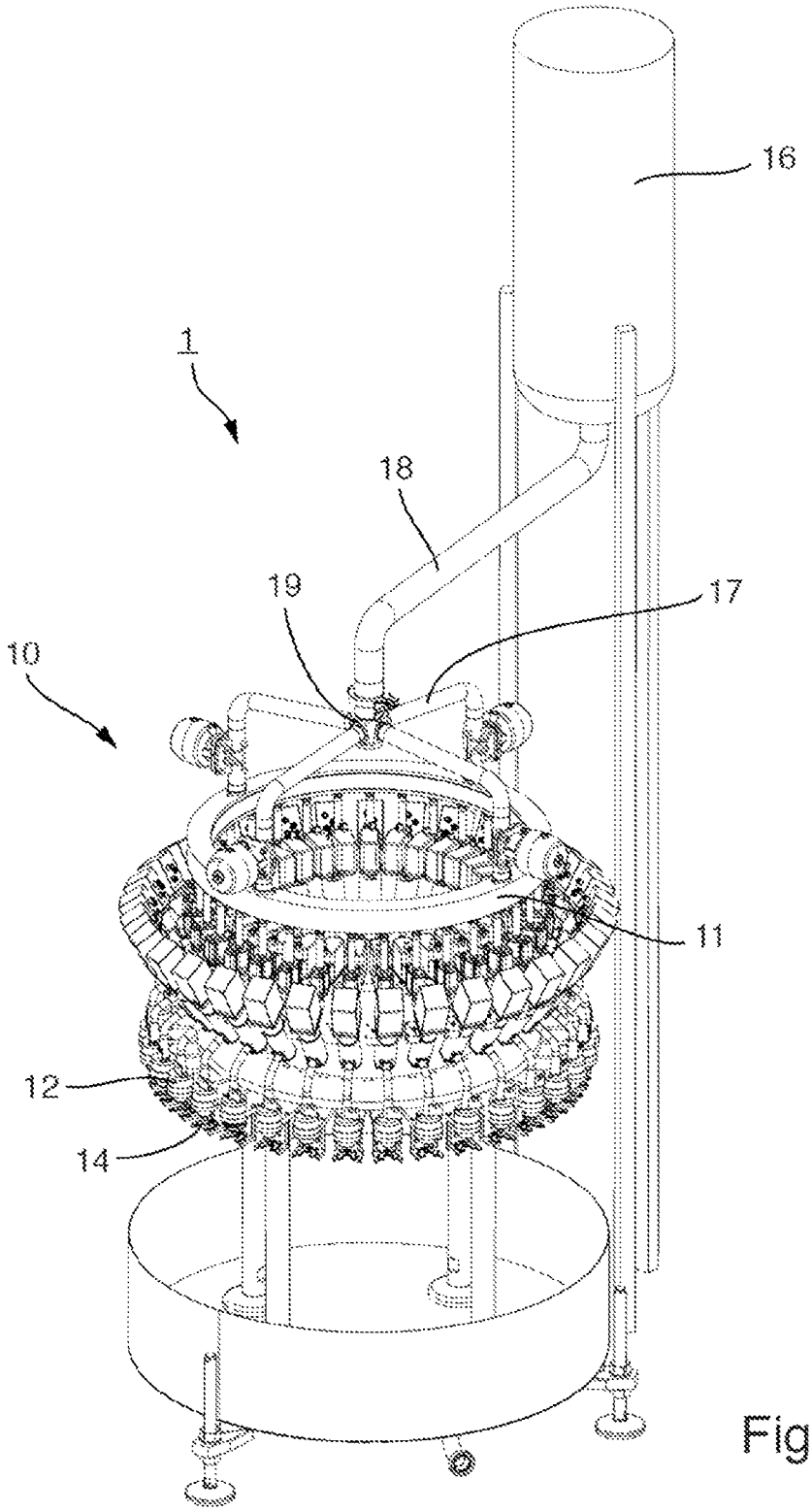
FIG. 1 schematically shows a perspective representation of a filler carousel having an adjacent filling-product reservoir.

FIG. 1 schematically shows a perspective representation of a filler carousel 10 that includes a multiplicity of filling valves 12 arranged on the filler carousel 10 and around its circumference, which respectively include a filling-valve outlet 14 below which the containers to be filled (not shown in this figure) are respectively arranged. Through the respective filling-valve outlet 14, the respective container to be filled, arranged underneath, is filled with a filling product. The filling valve 12 is used to fill each container to be filled with the desired volume, the desired mass or the desired filling level of filling product. During the filling operation, the filler carousel 10 rotates about its rotation axis in order to produce a constant flow of filled containers.

An adjacent filling-product reservoir 16 in the form of an adjacent filling-product tank is provided. The filling product is stored in the filling-product reservoir 16 before the actual filling of the containers to be filled.

The filling level of the filling product in the filling-product reservoir 16 may be kept constant by means of a separate mechanism, for example by means of a filling-level sensor in the filling-product reservoir 16, by means of which a feed of filling product into the filling-product reservoir 16 is regulated. An advantage of keeping the filling level in the filling-product reservoir 16 constant is that the pressure and flow conditions in the system regions lying downstream of the filling-product reservoir 16 can be determined more simply since the hydrostatic pressure applied by means of the filling-product reservoir 16 is always the same.

As an alternative or in addition, however, the filling level of the filling product in the filling-product reservoir 16 may be determined by means of a filling-level sensor and the system parts lying downstream of the filling-product reservoir 16 may be controlled or regulated according to the filling level of the filling product.

The filling-product reservoir 16 is connected by means of a filling-product line 18, which is fed via a rotary distributor 19 to the filler carousel 10, to the individual filling valves 12. Correspondingly, all the filling valves 12 are connected by means of the filling-product supply line 18 and the rotary distributor 19 to the adjacent filling-product reservoir 16.

In the embodiment shown, the individual filling valves 12 are connected to one another by means of a ring line 11 located on the filler carousel 10, and the ring line 11 is in communication with the filling-product supply line 18 via four distributor lines 17 with the interposition of the rotary distributor 19. Here, other line-based configurations may also be provided for connecting the filling-product supply line 18 to the filling valves 12.

By the design of the filler with an adjacent filling-product reservoir 16, construction of a tank on the filler carousel 10 can be obviated, so that costs can be saved. Besides the filling-product reservoir 16 which is simpler to construct, the filler carousel 10 itself may also be dimensioned smaller in relation to the bearings and the statics because of the lower rotating mass, and the required drives and drive energies can be reduced. This leads not only to a lower investment volume but also reduced operating costs.

During ongoing filling operation, containers to be filled are supplied in a manner known per se to the filler carousel 10 in the region of the respective filling-product outlets 14 of the filling valves 12, and are filled at these, and then the filled containers are then once again removed in a manner known per se from the filler carousel 10.

At the start of the respective filling operation, correspondingly, a first container is initially supplied and the corresponding filling valve 12 is open. The second container to be filled is then supplied and the second filling valve 12 is opened. This is continued until a stabilized equilibrium has been set up and all the filling locations in the filling angle are occupied.

Correspondingly, at the start of the respective filling operation, the filling valves 12 are set from a situation in which all the filling valves 12 are closed to an operation in which a large number of filling valves 12 are open simultaneously. During full filling operation, a large number of filling valves 12 are then operated simultaneously—this being a stabilized equilibrium since a filling valve 12 is constantly being opened at the start of the filling angle the start of the filling angle, and another filling valve 12 is being closed shortly before or shortly after this at the end of the filling angle. During full filling operation, the supplied flow of containers to be filled is correspondingly filled with the filling product, and after the conclusion of the filling method a flow of filled containers can leave the filler carousel 10 again. This operation of a filler carousel 10 is widely known.

The filling valves 12 which are shown in FIG. 1 are so-called control valves, or proportional valves, the control valves being correspondingly configured in such a way that besides a fully closed position and a fully open position, they also allow at least one intermediate position, for example, a multiplicity of intermediate positions, or a continuous adjustment of the active filling cross section. Correspondingly, a filling-valve disk can be raised from its corresponding filling-valve seat in stages or continuously, so that the annular gap formed between the filling-valve disk and the filling-valve seat, or the cross section thereof, can be correspondingly varied in the aforementioned stages or continuously. Correspondingly, the filling valve configured in this way as a control valve makes it possible to control the flow of filling product through the filling valve 12 by means of the setting of the filling-valve disk relative to the filling-valve seat.

Control valves are also used at other positions inside a filling-product filling system, in order to vary through-flows of media and in particular of the filling product. The explanations given below in the present disclosure are made with reference to the example of a filling device in which control valves are used as filling valves 12. The considerations may, however, be applied in principle to the control and regulation of any control valve inside a filling-product filling system.

The explanations below, which are given with reference to filling valves 12 configured as control valves, are therefore also applicable, for example, to designs of a filling-product filling system in which control valves for flow variations are respectively also provided before the actual filling valves, in that case configured as simple switchover valves (on/off). The explanations are, for example, also applicable to designs in which a single control valve is provided in the feed to a filler—such a design is described, for example, in FIG. 10.

First, however, reference will be made below to a design in which all the filling valves 12 considered are configured as control valves.

Conventionally, each filling valve 12 is in communication with an individual flow meter or a load cell in such a way that a desired volume flow can be specified, which may then be adjusted by the filling valve 12 by means of its assigned flow meter.

To this end, conventionally, the filling valve 12 is initially moved into a predetermined opening position, which is also referred to as a precontrol position, of which it is assumed that it corresponds to the desired volume flow, and the volume flow to be set is then accurately adjusted correspondingly by means of the flow meter by variation of the opening excursion of the filling valve 12.

The precontrol position has to date been determined for equilibrium operation and is correspondingly aimed at the conditions during equilibrium operation.

In the exemplary embodiment shown for the filler, in which all the filling valves 12 are in communication via the filling-product supply line 18 with the adjacent filling-product reservoir 16, however, the opening of each individual filling valve 12 leads to varying pressure conditions in the filling-product supply line 18. This is due, inter alia, to the hydraulic inductance of the fluid in the filling-product supply line 18. Correspondingly, the start of the filling method, when initially a first filling valve 12 and then subsequently more and more filling valves 12 are opened, starting from an initial differential pressure a reduction becoming gradually slower in the differential pressure takes place, which correspondingly influences the volume flow through the already opened filling valves 12.

Figure 2:
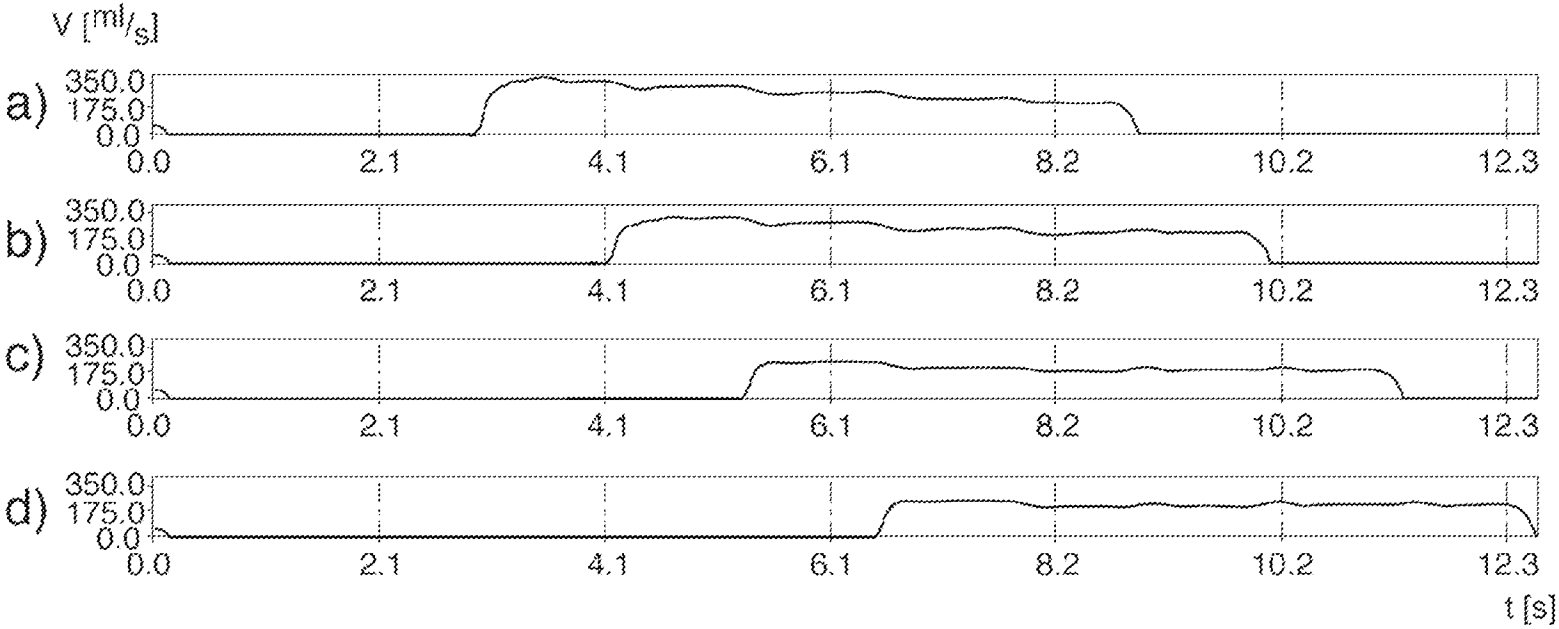
FIG. 2 shows a schematic representation of the volume flows, measured by way of example, of four filling valves connected in parallel without compensation.

This behavior is schematically shown in FIG. 2, in which the volume flow through four directly neighboring filling valves a)-d) that are switched on successively at an interval of about 1 second is shown.

In the case of adjustment of the first filling valve 12 to the precontrol position determined in equilibrium operation, the expected volume flow is therefore not achieved, but rather a higher volume flow which then gradually decreases. This is schematically shown once more in FIG. 3, in which the behavior of the filling valve a) of FIG. 2 is shown once more at a higher resolution. The decline in the volume flow in this particular measured example is more than 100 ml/sec.

The same takes place at the end of the filling operation, when the last containers to be filled are received in the filler carousel 10 and more and more filling valves 12 are closed, until finally only a last filling valve 12 is still left, which is then closed. In this case, a gradual rise in the pressure takes place, so that correspondingly the flow conditions and, in particular, the volume flow through the individual remaining or continuing filling valves 12 varies.

Figure 3:
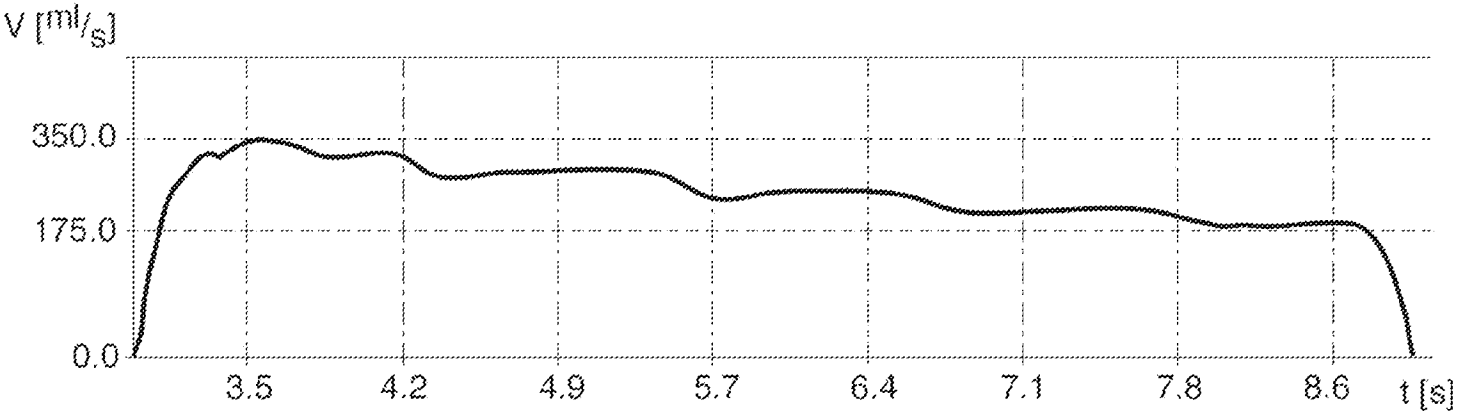
FIG. 3 shows a schematic representation of a volume flow, measured by way of example, of a filling valve in the case of successive opening of further filling valves connected in parallel in an enlarged detail representation.

The observed behavior at the end of the filling operation therefore corresponds substantially to that of FIGS. 2 and 3, but with a temporally reversed profile in which the volume flow of the last filling valve 12 then correspondingly increases.

The control loop between an individual filling valve 12 and the flow meter assigned to this filling valve 12 is too slow for reliable compensation of these volume flow variations.

In order to better understand this behavior of the filling valves 12, the following considerations are to be taken into account.

The basis of the improved regulating process proposed here is accurate knowledge about the filling valve 12, and in particular about the control valve respectively used. In this case, knowledge about the relationship between the conductance $K_V$ and the excursion H of the control valve is relevant:

First, a function of the conductance $K_V(H)$ of the control valve is determined for each opening position H of the control valve. The conductance $K_V$ is also referred to as the flow factor or flow coefficient of the control valve. It is a measure of the achievable throughput of a liquid or of a gas through the control valve, is given here in units of ml/sec and may be interpreted as an effective cross section. Each $K_V$ value applies only for the associated opening position H of the control valve.

In order to determine the conductance $K_V$, in an initial calibration process a particular opening position of the control valve is moved to, the filling-product flow q(H) out of the control valve with this opening position is measured, and from this in the stabilized state the conductance $K_V$ is determined, for example by means of a measurement by means of a measuring cell such as a load cell. This is carried out for a multiplicity of discrete opening positions of the control valve.

There is the following relationship between the $K_V$ value and the volume flow $q_\infty$ (volume flow through the filling valve in the stabilized state):

$$q_\infty = K_V * \sqrt{\frac{\Delta p}{1000\ \text{mbar}} * \frac{1000\ \text{kg/m}^3}{\rho}} \tag{1}$$

with Δp the differential pressure between the filling-valve outlet and the pressure above the control valve, and p the density of the filling product flowing through the control valve.

Correspondingly, for exact determination of the conductance $K_V$, besides the aforementioned measurement of the volume flow with a particular opening position, the differential pressure Δp and the density p of the filling product flowing through the control valve also need to be determined.

The density p of the filling product is usually known, or may be determined by means of the known measurement methods. For water and filling products similar to water, which are predominantly filled in beverage filling systems, the density may be assumed to be approximately 1000 $kg/m^3$, so that it then does not need to be modified for a multiplicity of filling products to be filled.

Correspondingly, from the volume flow q measured for a particular opening position the differential pressure Δp which has been determined, and the density p which has been determined, the $K_V$ value for this opening position can now be determined by:

$$K_v(H_i) = q_\infty * \sqrt{\frac{1000\ \text{mbar}}{\Delta p} * \frac{\rho}{1000\ \text{kg/m}^3}} \tag{2}$$

In order in this case to determine a function of the conductance $K_V$ (H) as a function of the opening positions $H_i$, after the determination of all the conductances $K_V$ ($H_i$), a function of the conductance as a function of the opening positions of the control valve is determined by determining a best-fit curve through the respective conductances $K_V$ ($H_i$). The best-fit curve may for example be determined by linear regression, the method of least squares, a fitting algorithm or other known methods for determining a best-fit curve through measurement values. This determination and calculation is carried out for different discrete values of the opening position $H_i$.

Figure 4:
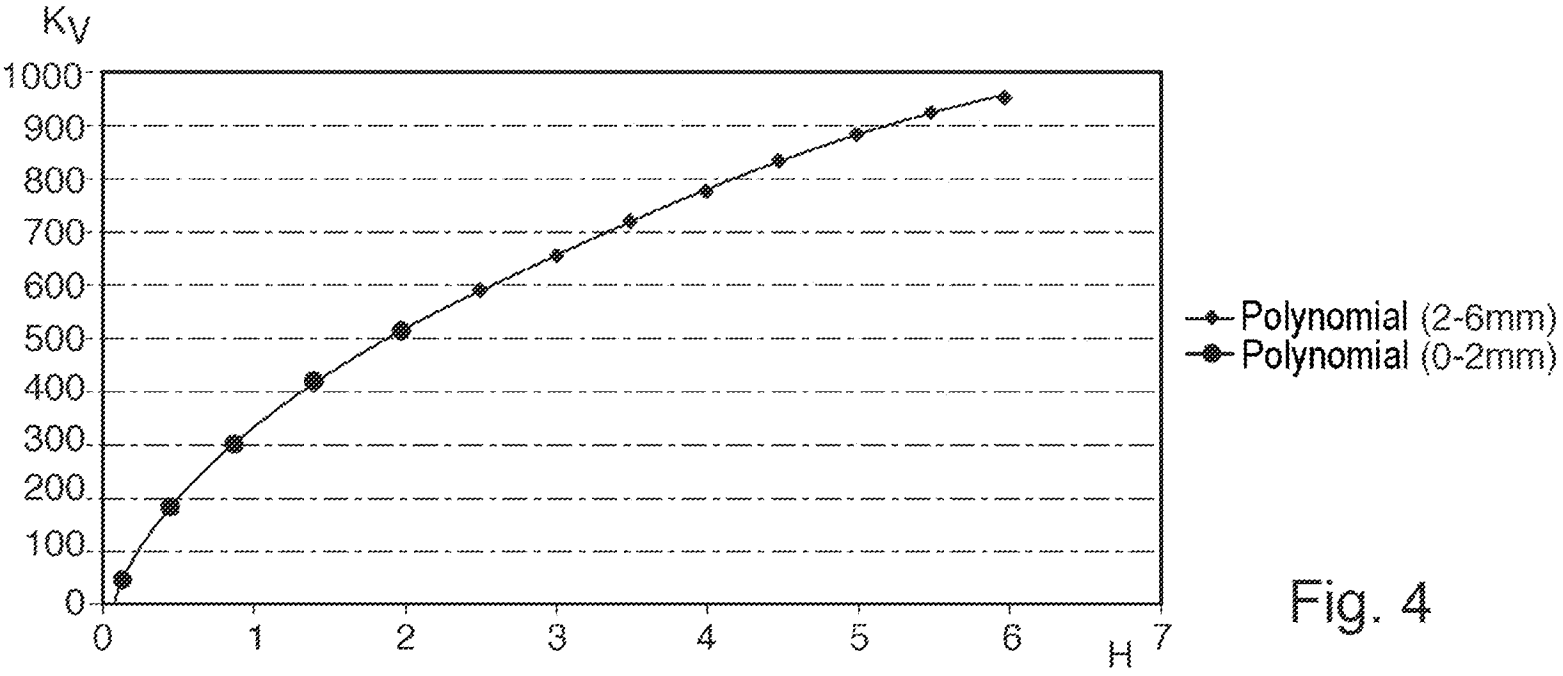
FIG. 4 shows a schematic representation of a curve of a conductance $K_V$ as a function of the excursion H of a proportional valve.

As a best-fit curve, for example, a $6^{th}$ order polynomial may be used, as is shown for example in FIG. 4, in which the conductance is plotted as a function of the respective opening position of the control valve. In FIG. 4, in order to determine the best-fit curve, a first value range of the opening positions of from 0 to 2 mm and a second value range of the opening positions of from 2 mm to 6 mm were used. In this case, in order to form the curve of the $K_V$ values 2 as a function of the opening position H of the control valve, the discrete values 20 in the first value range and the discrete values 22 in the second value range were correspondingly used in order to form a best-fit curve by using a $6^{th}$ order polynomial.

For a particular excursion H of the control valve, for example, the following is thereby obtained as a best-fit curve of the conductance $K_V$:

$$K_V(H)=c_6*H^6+c_5*H^5+c_4*H^4+c_3*H^3+c_2*H^2+c_1*H+c_7 \tag{3}$$

Where $c_1$ to $c_7$ are the corresponding coefficients for fitting the function to the measurement values.

By determining the best-fit function, all intermediate values of the opening positions may then also be taken into account during the filling. For stabilized states, for each opening position, the corresponding volume flow can therefore be calculated:

$$q_\infty(H) = K_v(H) * \sqrt{\frac{\Delta p}{1000\ \text{mbar}} * \frac{1000\ \text{kg/m}^3}{\rho}} \tag{4}$$

In this case, however, it should be noted that this function of the conductance $K_V$ (H) of the control valve for each opening position involves the respective volume flow in the stabilized state, i.e. after keeping the opening position constant and prolonged waiting. When opening or closing the control valve, or moving it from one opening position into another opening position, however, further dynamic influences also become relevant.

In order to consider the dynamic influences due to opening or closing of the neighboring or other filling valves, configured as a control valve, of the filler carousel, an analogy will initially be drawn from the field of electrical engineering, the electrical-mechanical analogy given in the table below being used:

| electrical consideration | mechanical consideration |
|---|---|
| ohmic resistance | Kv value |
| voltage | differential pressure |
| current | volume flow |
| inductance | accelerated mass |

Figure 5:
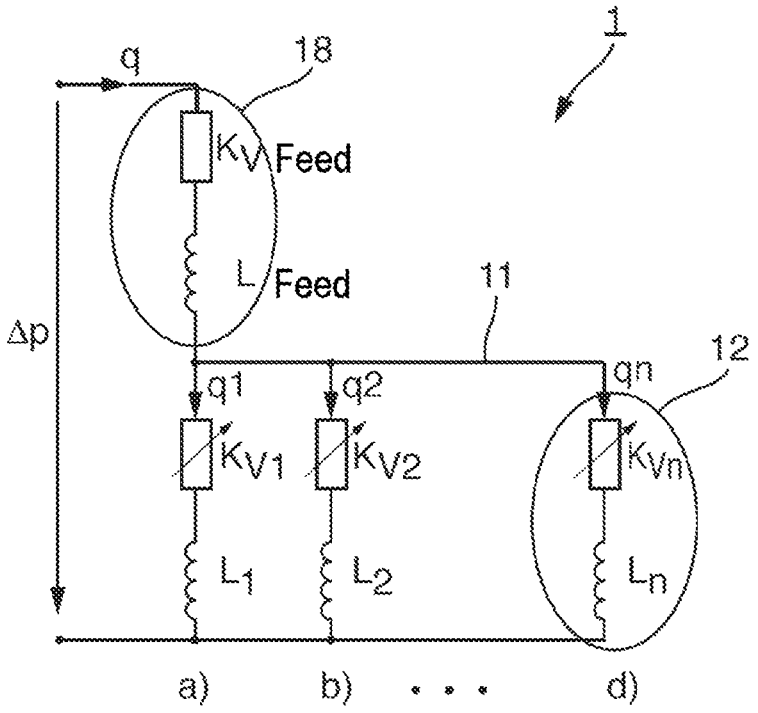
FIG. 5 shows an equivalent circuit diagram in an electrical-fluidic analogy of the filler structure according to FIG. 1.

Correspondingly, FIG. 5 schematically represents the fluid-mechanical design of a few filling valves 12 *a*) to *d*) configured as control valves, which are in communication via the filling-product supply line 18 with the adjacent filling-product reservoir, in an electrical-fluidic analogy with the aid of an equivalent circuit diagram.

In FIG. 5:

$K_{Vfeed}$: conductance of feed $K_{V1-n}$: conductance of an individual filling valve Lfeed: hydraulic inductance of feed $L_{1-n}$: hydraulic inductance of filling valve Δp: differential pressure q: volume flow of feed q1–n: volume flow of filling valve n: number of filling valves The opening position, or the degree of opening, of the filling valve 12 influences the system variables $K_{V1-n}$ and $L_{1-n}$ and therefore indirectly the potential and flow quantities.

The filling-product supply line 18 correspondingly includes a hydraulic inductance $L_{feed}$ and a conductance $K_{V-feed}$, with which the behavior of the filling-product supply line 18 can correspondingly be described according to the electrical-fluidic analogy.

The total volume flow q, which is delivered from the adjacent filling-product reservoir comes, is correspondingly supplied via the filling-product supply line 18 to the individual filling valves 12.

The individual filling valves 12 are connected in parallel with one another and are all connected to the filling-product supply line 18. Each filling valve 12 correspondingly likewise has a hydraulic inductance $L_1$ and a conductance $K_{V1}$, by means of which the flow behavior of each filling valve 12 may be represented according to the electrical-fluidic analogy.

Figure 6:
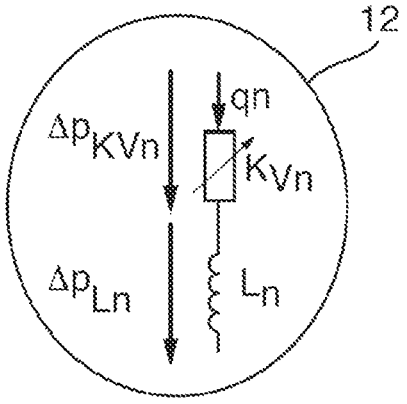
FIG. 6 shows an equivalent circuit diagram in an electrical-fluidic analogy of an individual filling valve.

Thus, in order to achieve an improved control and/or regulation behavior of the filling-product filling system 1, in particular at the start and at the end of the respective filling operation, the following further considerations are to be noted:

FIG. 6 schematically represents the structure of an individual filling valve 12 configured as a control valve.

The differential pressure as a function of the conductance is given as:

$$\Delta p_{K_v}(t) = \left(\frac{q(t)}{K_v}\right)^2 \cdot 1\ \text{bar} \cdot \frac{\rho}{1000\ \frac{\text{kg}}{\text{m}^3}} \tag{5}$$

The differential pressure as a function of the hydraulic inductance is given as:

$$\Delta p_{L_h}(t) = L_h \cdot \frac{dq(t)}{dt} \tag{6}$$

The hydraulic inductance being given as $$L_h = \frac{l \cdot \rho}{A} \tag{7}$$

with l=effective line

ρ=density of the liquid

A=effective flow cross section

The formula may be applied to more complicated line geometries in infinitesimally small sections. The resulting individual inductances are then to be added, or integrated, to give an overall inductance.

The differential equation of the individual valve will be set up and solved for the volume flow. This calculated volume flow will finally be transferred to a conventional regulating algorithm for compensating the volume flow declines—for example by means of effecting a precontrol position.

Figure 7:
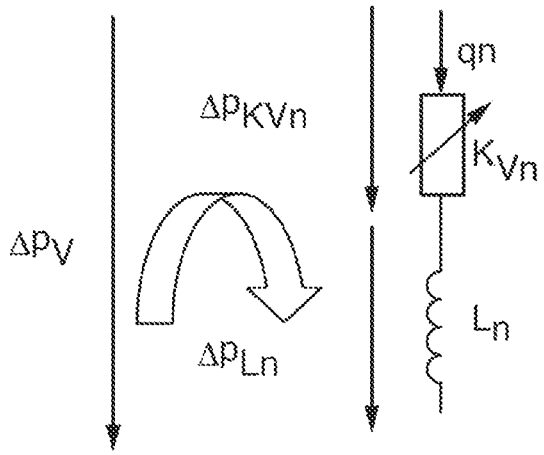
FIG. 7 shows an equivalent circuit diagram in an electrical-fluidic analogy of an individual filling valve taking the differential pressure into account.

FIG. 7 schematically shows the consideration for an individual path on this basis. From this consideration, the differential pressure $\Delta p_v$ of the control valve being considered over this individual path is given as:

$$\Delta p_v = \Delta p_{K_v} + \Delta p_{L_h} = \left(\frac{q(t)}{K_v}\right)^2 \cdot 1\ \text{bar} \cdot \frac{\rho}{1000\ \frac{\text{kg}}{\text{m}^3}} + L_h \cdot \frac{dq(t)}{dt} \tag{8}$$

This Kirchhoff circuit law is now to be set up for each of the filling valves 12 of the respective filling-product filling system 1, a complex system of differential equations correspondingly being obtained.

Figure 8:
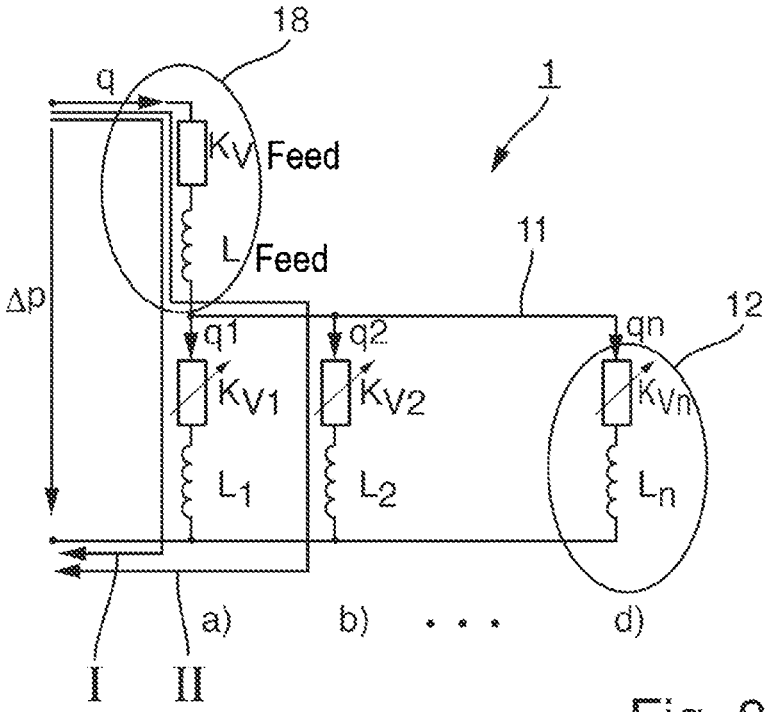
FIG. 8 shows a schematic representation of the individual paths in an equivalent circuit diagram in an electrical-fluidic analogy of the filler structure, for example according to FIG. 1.

The structure of the system of differential equations is given schematically by FIG. 8 in which the respective paths I, II, . . . , which respectively represent a row of the system of differential equations, are shown.

This system of differential equations describes the mutual influencing of the filling valves 12 in the case of parallel connection of the filling valves 12 in the differential pressure $\Delta p_v$ decreasing across these filling valves 12.

Such a system of differential equations, however, is no longer analytically solvable, but must be solved numerically. With the available computing power of the control computer, however, this is not practicable during full operation and would be too slow. Furthermore—as revealed by FIG. 8—the material quantities $K_{V_{feed}}$ and $L_{feed}$ would also need to be determined and measured for the respective machine.

Figure 9:
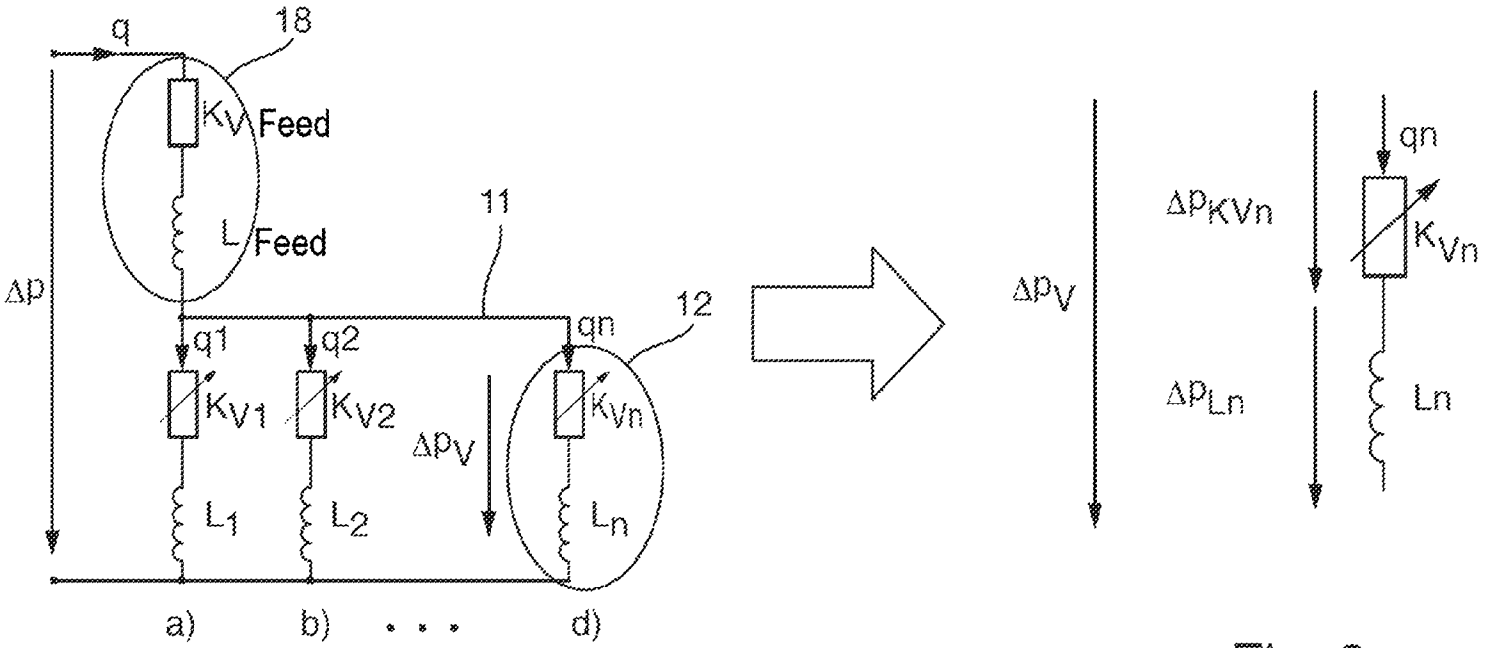
FIG. 9 shows a schematic representation of superposition of the reduction of the differential equations from the Kirchhoff circuit laws taking into account the differential pressure.

In order to solve this problem, the underlying equivalent circuit diagram and therefore the system of differential equations are reduced. It has been found, as may be seen from FIG. 9, that by measuring the differential pressure $\Delta p_v$ across the parallel circuit of the filling valves 12, the equivalent circuit diagram can be reduced and a separate determination of the conductance and of the hydraulic inductance can be obviated.

In other words, by measuring the differential pressure $\Delta p_v$ across the individual filling valve 12, or across the parallel circuit of the active filling valves 12 a simple determination of the through-flow can be achieved.

The differential pressure $\Delta p_v$ in the filling-product filling system 1 may be determined in a simple way by means of corresponding pressure sensors. The pressure sensors have a very short reaction time, which lies for example in the range of 1 ms, and are sufficiently accurate. A very rapid measurement of the differential pressure $\Delta p_v$ is therefore obtained, and therefore the possibility of rapid determination of the resulting volume flow through the respective filling valve.

The following solution for the volume flow $q_n(t)$ of the respective $n^{th}$ individual valve when there is a measured differential pressure $\Delta p_v$ may therefore be found as:

$$q_n(t) = \begin{cases} q_{n_\infty} \cdot \tanh\left(\frac{\Delta p_v}{q_{n_\infty} \cdot L_h} \cdot t + \operatorname{arctanh}\left(\frac{q_{n_0}}{q_{n_\infty}}\right)\right), & \text{if } q_{n_0} < q_{n_\infty} \\ q_{n_\infty} \cdot \coth\left(\frac{\Delta p_v}{q_{n_\infty} \cdot L_h} \cdot t + \operatorname{arccoth}\left(\frac{q_{n_0}}{q_{n_\infty}}\right)\right), & \text{if } q_{n_0} > q_{n_\infty} \\ q_{n_0}, & \text{if } q_{n_0} = q_{n_\infty} \end{cases} \tag{9}$$

where $q_{n_0}$ is the volume flow of the $n^{th}$ filling valve at start of the consideration, and the volume flow $q_{n_\infty}$ of the $n^{th}$ filling valve in the respective fully stabilized state is given as:

$$q_{n_\infty} = K_v \cdot \sqrt{\frac{\Delta p}{1\ \text{bar}} \cdot \frac{1000\ \frac{\text{kg}}{\text{m}^3}}{\rho}} \tag{10}$$

To a first approximation, however, the same pressure prevails at the filling-valve outlet 14 of all the filling valves 12. This pressure may be, for example, the ambient pressure in the case of a free-jet method or the pressure of a prestress applied in a defined way in the container to be filled. The corresponding pressure at the filling-valve outlet 14 is thus in principle known and, to a first approximation, equal at the respective filling start for each filling valve 12.

Furthermore, because of the common connection of all the filling valves 12 to the filling-product supply 18—for example by the ring line 11—likewise, to a first approximation, the same pressure prevails above the filling valves 12. Correspondingly, in order to simplify the method, individual consideration of the individual filling valves 12 may be obviated. In other words, the measured differential pressure $\Delta p_v$ corresponds to the differential pressure across all the active control valves which are present in the corresponding parallel circuit.

The volume flow q(t) of the respective individual filling valve 12 is therefore given, taking into account the aforementioned assumptions for each filling valve 12, on the basis of measurement of the pressure in the filling-product supply 18, or in the ring line 11, knowledge of the pressure at the filling-valve output 14 and determination of the differential pressure $\Delta p_v$ resulting therefrom, as:

$$q(t,\ \Delta p_v) = \begin{cases} q_\infty \cdot \tanh\left(\frac{\Delta p_v}{q_\infty \cdot L_h} \cdot t + \operatorname{arctanh}\left(\frac{q_0}{q_\infty}\right)\right), & \text{if } q_0 < q_\infty \\ q_\infty \cdot \coth\left(\frac{\Delta p_v}{q_\infty \cdot L_h} \cdot t + \operatorname{arccoth}\left(\frac{q_0}{q_\infty}\right)\right), & \text{if } q_0 > q_\infty \\ q_0, & \text{if } q_0 = q_\infty \end{cases} \tag{11}$$

with $$q_\infty = K_v \cdot \sqrt{\frac{\Delta p}{1\ \text{bar}} \cdot \frac{1000\ \frac{\text{kg}}{\text{m}^3}}{\rho}} \tag{12}$$

Correspondingly, when determining the differential pressure $\Delta p_v$ through the parallel circuit of the filling valves 12, which correspondingly applies for each filling valve 12, the mutual influencing of the filling valves 12 is fully introduced into the individual calculation of the volume flow.

The volume flow $q(t,\Delta p_v)$ calculated in this way on the basis of the differential pressure $\Delta p_v$ is then transferred to control or regulation in order to achieve corresponding control of the valve position of the respective control valve in order to maintain the predetermined setpoint volume flow.

This is will be used particularly for the precontrol of the respective control valve, the control valve then being controlled in its opening on the basis of the respective currently measured differential pressure $\Delta p_v$ so that the desired volume flow is preadjusted.

In this way, it is possible to achieve the effect that, particularly at the start of the filling operation or at the end of the filling operation, when only a few filling valves 12 are active, compensated adjustment of the precontrol position and of the operating position of the filling valves 12 is achieved.

The regulation which is carried out on the basis of the volume flow $q(t,\Delta p_v)$ respectively calculated on the basis of the currently measured differential pressure $\Delta p_v$ may be modulated onto the other control and/or regulation steps of a superordinate system controller.

The remaining control and/or regulation behavior of the individual filler valve 12—for example in order to achieve a predetermined flow curve for filling the container to be filled according to a volume-flow profile adapted to the filling product and container—is not thereby altered. Rather, by the compensation by means of the volume flow $q(t,\Delta p_v)$ calculated on the basis of the currently measured differential pressure $\Delta p_v$, more accurate compliance with the required volume-flow profile can be achieved independently of the number of filling valves 12 simultaneously opened.

The compensation method may be applied at the start and at the end of the respective filling operation, until a stabilized equilibrium of the number of filling valves 12 opened in parallel with one another has respectively been obtained during full operation.

The method may, however, also be compensated continuously throughout full operation in order to compensate the opening position of all the filling valves 12 while taking into account the differential pressure $\Delta p_v$.

The control method may therefore, for example, also be carried out as follows:

filling valve n is open and the volume flow through filling valve n is constantly stabilized filling valve n+1 is opened. The differential pressure $\Delta p_v$ across the parallel circuit of the filling valves therefore varies this is detected by the corresponding pressure sensors and the volume flow, which correspondingly decreases, is calculated on the basis of this the calculated volume flow is transferred to the regulation as a control variable the regulation increases the opening excursion at filling valve n so that the desired setpoint volume flow (reference variable) is maintained.

This procedure also works well because the differential pressure $\Delta p_v$ can be sampled and measured in a short cycle of for example 5 ms, and because filling valve n+1 causes a variation of the differential pressure $\Delta p_v$ relatively slowly with the (slow) opening excursion.

Figure 10:
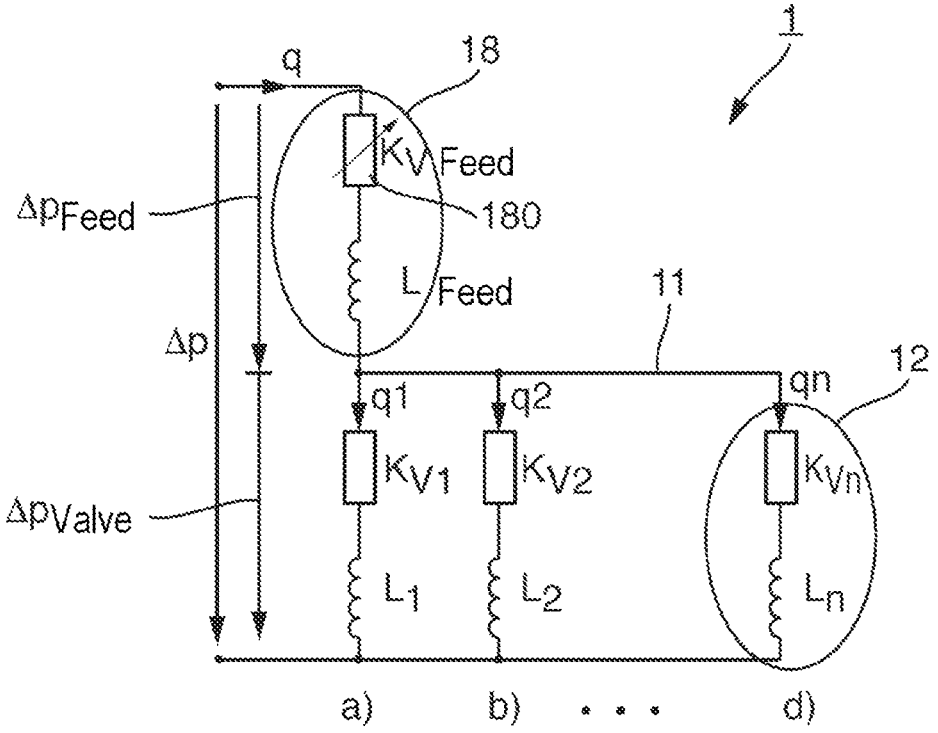
FIG. 10 shows a schematic representation of an alternative embodiment.

An alternative design of the circuit is provided in FIG. 10. A control valve 180, by means of which the common feed flow to the separate individual filling valves 12 can be regulated, is provided in the filling-product supply line 18. The filling valves 12 in the exemplary embodiment shown are configured not as control valves but as simple switchover valves (on/off).

Correspondingly, the regulation behavior of the filling valves 12, which is achieved in the above-described embodiments by means of the filling valves configured as control valves, is undertaken in this embodiment by a control valve 180 arranged in the filling-product supply line 18.

It is therefore possible to regulate the filling valves 12 with the aid of standardized regulation specifications, without a precontrol behavior controlled by the number of open filling valves 12 having to be applied.

The control valve 180 in the feed 18 therefore exhibits a behavior in which regulation initially is carried out with a low conductance $K_V$ at the start of production, and then the first filling valve 12 is opened. Synchronously with the increase in the number of opened control valves 12, the conductance $K_V$ of the control valve 180 is then gradually increased so that each individual filling valve 12 in principle experiences the same differential pressure.

In other words, by means of the control valve 180 in the feed, the pressure drop $\Delta p_{Feed}$ is varied so that $\Delta p_{Valve}$ can be kept constant.

If applicable, all individual features which are presented in the exemplary embodiments may be combined and/or replaced with one another without departing from the scope of the invention.

The invention claimed is:

1. A method for filling a container with a filling product in a filling-product filling system having at least two filling valves connected in parallel with one another, wherein the at least two filling valves are provided as control valves, comprising:

determining a function of a volume flow $q(t, \Delta p_v)$ for the at least two filling valves as a function of a differential pressure $\Delta p_v$ across all filling valves connected in parallel;

determining the differential pressure $\Delta p_v$ across all the filling valves connected in parallel;

calculating the volume flow $q(t, \Delta p_v)$ through at least one filling valve of the at least two filling valves on the basis of the determined differential pressure $\Delta p_v$; and regulating and/or controlling the at least one filling valve as a function of the calculated volume flow $q(t, \Delta p_v)$, wherein regulating and/or controlling the at least one filling valve comprises adjusting an opening position of the at least one filling valve based at least in part on the calculated volume flow $q(t, \Delta p_v)$, in the event of the determined differential pressure $\Delta p_v$ changing.

2. The method of claim 1, wherein the function of the calculated volume flow $q(t, \Delta p_v)$ is given as the function of the differential pressure $\Delta p_v$ by $$q(t, \Delta p_v) = \begin{cases} q_\infty \cdot \tanh\left(\frac{\Delta p_v}{q_\infty \cdot L_h} \cdot t + \operatorname{arctanh}\left(\frac{q_0}{q_\infty}\right)\right), & \text{if } q_0 < q_\infty \\ q_\infty \cdot \coth\left(\frac{\Delta p_v}{q_\infty \cdot L_h} \cdot t + \operatorname{arccoth}\left(\frac{q_0}{q_\infty}\right)\right), & \text{if } q_0 > q_\infty \\ q_0, & \text{if } q_0 = q_\infty \end{cases}$$

-continued where $$q_\infty = K_v \cdot \sqrt{\frac{\Delta p}{1\ \text{bar}} \cdot \frac{1000\ \frac{\text{kg}}{\text{m}^3}}{\rho}}$$

is the volume flow through the at least one filling valve in a stabilized state.

3. The method of claim 1, wherein regulating and/or controlling the at least one filling valve is carried out based at least in part on a predetermined volume-flow profile for the filling of the container to be filled with the filling product.

4. The method of claim 1, wherein regulating and/or controlling the at least one filling valve is carried out as the function of the calculated volume flow $q(t, \Delta p_v)$ only at a start and/or an end of a filling operation.

5. The method of claim 4, wherein regulating and/or controlling the at least one filling valve is carried out before a stabilized equilibrium is reached at simultaneously opened filling valves.

6. The method of claim 1, wherein regulating and/or controlling the at least one filling valve is carried out as the function of the calculated volume flow $q(t, \Delta p_v)$ only when the resulting regulation and/or control exceeds a predetermined threshold.

7. A method for filling a container with a filling product in a filling-product filling system having at least two filling valves connected in parallel with one another, wherein the at least two filling valves are provided as control valves, comprising:

determining a function of a volume flow $q(t, \Delta p_v)$ for the at least two filling valves as a function of a differential pressure $\Delta p_v$ across all filling valves connected in parallel;

determining the differential pressure $\Delta p_v$ across all the filling valves connected in parallel;

calculating the volume flow $q(t, \Delta p_v)$ through at least one filling valve of the at least two filling valves on the basis of the determined differential pressure $\Delta p_v$; and regulating and/or controlling the at least one filling valve as a function of the calculated volume flow $q(t, \Delta p_v)$, wherein regulating and/or controlling the at least one filling valve comprises:

moving the at least one filling valve into an opening position, and adjusting the opening position of the at least one filling valve based at least in part on the calculated volume flow $q(t, \Delta p_v)$, in the event of the determined differential pressure $\Delta p_v$ changing.

8. The method of claim 7, wherein the function of the calculated volume flow $q(t, \Delta p_v)$ is given as the function of the differential pressure $\Delta p_v$ by $$q(t, \Delta p_v) = \begin{cases} q_\infty \cdot \tanh\left(\frac{\Delta p_v}{q_\infty \cdot L_h} \cdot t + \operatorname{arctanh}\left(\frac{q_0}{q_\infty}\right)\right), & \text{if } q_0 < q_\infty \\ q_\infty \cdot \coth\left(\frac{\Delta p_v}{q_\infty \cdot L_h} \cdot t + \operatorname{arccoth}\left(\frac{q_0}{q_\infty}\right)\right), & \text{if } q_0 > q_\infty \\ q_0, & \text{if } q_0 = q_\infty \end{cases}$$

where $$q_\infty = K_v \cdot \sqrt{\frac{\Delta p}{1\ \text{bar}} \cdot \frac{1000\ \frac{\text{kg}}{\text{m}^3}}{\rho}}$$

is the volume flow through the at least one filling valve in a stabilized state.

9. The method of claim 7, wherein regulating and/or controlling the at least one filling valve is carried out based at least in part on a predetermined volume-flow profile for the filling of the container to be filled with the filling product.

10. The method of claim 7, wherein regulating and/or controlling the at least one filling valve is carried out as the function of the calculated volume flow $q(t, \Delta p_v)$ only at a start and/or an end of a filling operation.

11. The method of claim 10, wherein the regulating and/or controlling the at least one filling valve is carried out before a stabilized equilibrium is reached at simultaneously opened filling valves.

12. The method of claim 7, wherein regulating and/or controlling the at least one filling valve is carried out as the function of the calculated volume flow $q(t, \Delta p_v)$ only when the resulting regulation and/or control exceeds a predetermined threshold.

* * * * *